United States Patent [19]

Cox et al.

[11] Patent Number: 4,537,265

[45] Date of Patent: Aug. 27, 1985

[54] SELF PROPELLED REVERSIBLE BORING RAM

[75] Inventors: William E. Cox, Woodbridge; Kenneth L. Hemmings, Colchester, both of England

[73] Assignee: British Telecommunications, London, England

[21] Appl. No.: 487,767

[22] Filed: Apr. 22, 1983

[51] Int. Cl.[3] ..... E21B 4/14; E21B 7/26; E21B 11/02

[52] U.S. Cl. ..... 175/19; 175/296; 173/91

[58] Field of Search ..... 173/91; 91/234; 166/324; 175/19, 296, 20, 21, 22, 23

[56] References Cited

U.S. PATENT DOCUMENTS

| | | | |
|---|---|---|---|
| 962,350 | 6/1910 | Hibschle | 91/234 X |
| 3,519,234 | 7/1970 | Matson | 248/156 |
| 3,727,701 | 4/1973 | Sudnishnikov | 173/91 |
| 3,744,576 | 7/1973 | Sudnishnikov | 175/91 |

FOREIGN PATENT DOCUMENTS

| | | | |
|---|---|---|---|
| 2735062 | 8/1979 | Fed. Rep. of Germany | 175/19 |
| 1438734 | 9/1976 | United Kingdom . | |
| 1438738 | 9/1976 | United Kingdom . | |
| 1392868 | 5/1975 | United Kingdom . | |
| 1501582 | 2/1978 | United Kingdom . | |
| 1517250 | 7/1978 | United Kingdom . | |
| 1517997 | 7/1978 | United Kingdom . | |
| 1540344 | 2/1979 | United Kingdom . | |
| 2049762 | 12/1980 | United Kingdom . | |
| 611988 | 7/1978 | U.S.S.R. | 175/19 |

*Primary Examiner*—Stephen J. Novosad
*Assistant Examiner*—Bruce M. Kisliuk
*Attorney, Agent, or Firm*—Cushman, Darby & Cushman

[57] ABSTRACT

A reversible boring ram having a tubular body containing a reciprocable hammer is provided with a pneumatically balanced control member which allows the direction of operation of the ram to be reversed without halting the hammer's reciprocation. The pneumatically balanced control member also allows easy starting of the device.

The control member includes a balance piston situated in a balance cylinder which is attached to the body of the ram, the balance cylinder being connected to an inlet channel in such a manner that forward pressure on the balance piston counteracts the backward pressure in the main cylinder. The control member may be spring biased into the position for forward motion.

10 Claims, 8 Drawing Figures

SELF PROPELLED REVERSIBLE BORING RAM

This invention relates to a self propelled percussion boring ram. In particular it relates to a ram capable of boring holes through the ground under roadways and footwalks. Such bore holes are widely used as service ducts, eg for telephone lines, electric power supplies and gas supplies.

The use of self propelled boring rams to make service ducts is well established and UK Patent Specification No. 1438738 describes a ram for this purpose. The ram of UK No. 1438734 is reversible so that, if it encounters an obstruction, it can back-out of its hole.

This invention relates to a reversible ram wherein the reversing mechanism is simple to actuate and sure of action.

According to this invention a self-propelled reversible ram comprises a tubular body which contains a reciprocable hammer and a pneumatically balanced control member for supplying working fluid to the hammer. Preferably the hammer has a main cylinder and the control member provides a control piston situated in said cylinder and an inlet channel for supplying working fluid into the cylinder.

In its perferred form the control member also includes a balance piston situated in a balance cylinder which is attached to the body of the ram wherein the balance cylinder is connected to the inlet channel in such a manner that the forward pressure on the balance piston counteracts the backward pressure in the main cylinder. Most suitably the control member is spring biased into the position for forward motion.

Figure 1:
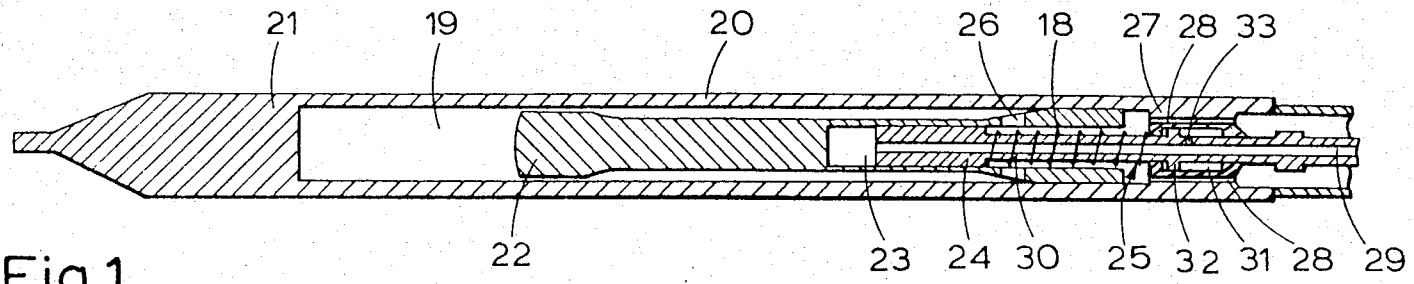
Figure 2:
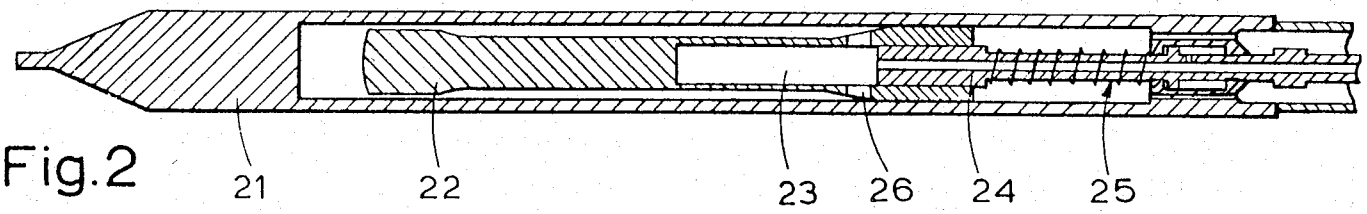
Figure 3:
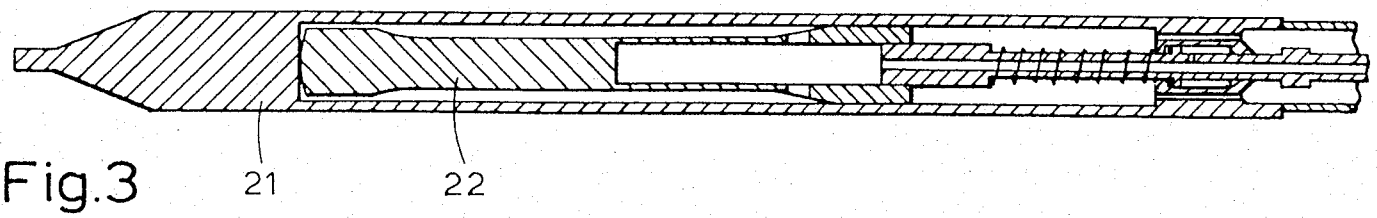
Figure 4:
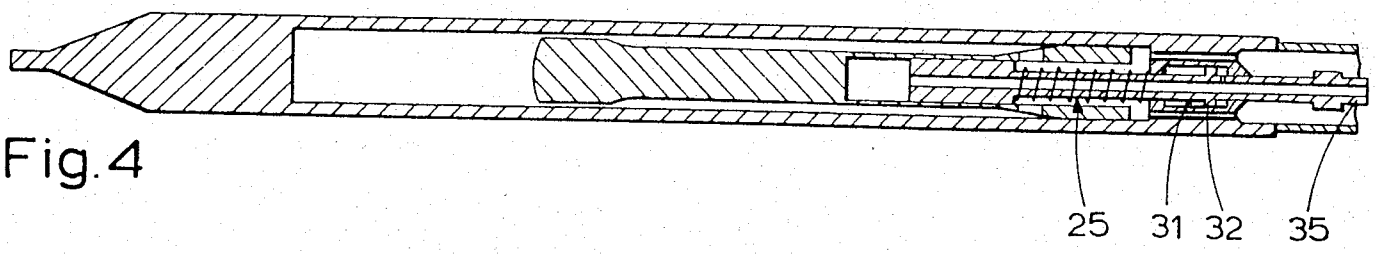
Figure 5:
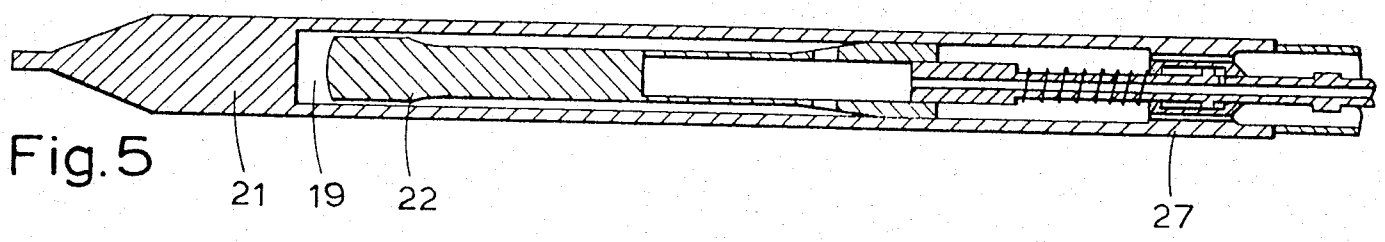
Figure 6:
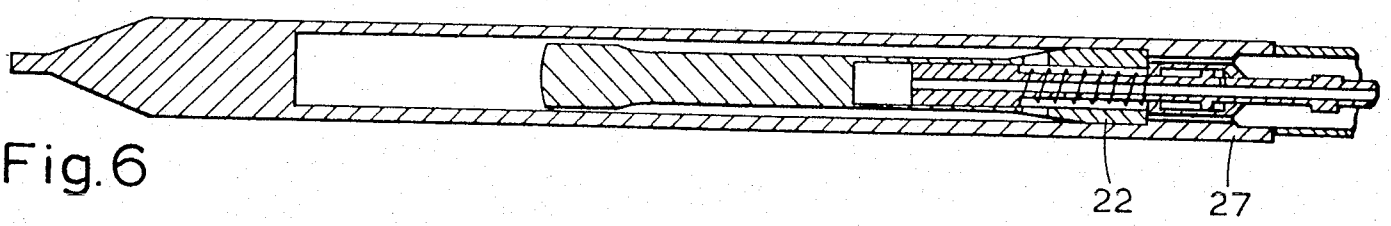
Figure 7:
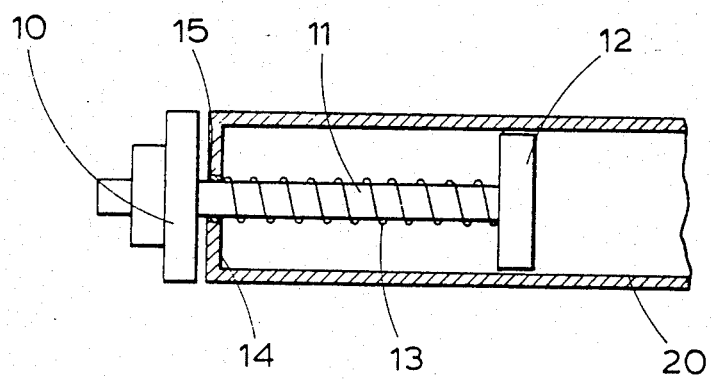
Figure 8:
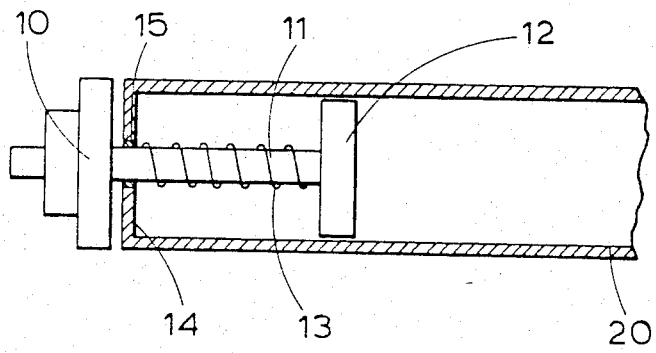

The invention will now be described by way of example with reference to the accompanying drawings in which:

FIGS. 1–3 illustrate, in diagrammatic cross-section, successive positions of the hammer during one cycle of operation in the forward mode, FIGS. 4–6 correspond to FIGS. 1–3 and illustrate the successive positions of the hammer in the reverse mode, and FIGS. 7 and 8 illustrate alternative boring heads.

As can be seen in FIG. 1, the ram comprises a tubular body 20 having an internal cavity 19. During use a boring head 21 is attached to the front end of the body. In the embodiment shown in FIGS. 1–6 the boring head 21 takes the form of a chisel which is rigidly attached to the front of the body. The internal cavity 19 of the body 20 contains a hammer 22 which has a main cylinder 23 connected via control ports 26 to the cavity 19. The cylinder 23 contains a control piston 24. A shaft 30 projects backwards from the control piston and is slidably mounted in a support block 27 which is securely attached to the body 20. The support block 27 has exhaust channels 28 which allow free passage of working fluid along the cavity 19. The support block 27 includes a balance cylinder 31 which contains a balance piston 32 attached to the shaft 30. The control piston 24, shaft 30 and balance piston 22 constitute the control member, generally indicated by the numeral 25, which is biased into the position shown by a bias spring 18.

The shaft 30 contains an inlet channel 29 for supplying working fluid to the cylinder 23. In addition the shaft 30 has a vent 33 which connects the inlet channel 29 to the rear part of the balance cylinder.

FIGS. 2–5 supplement FIG. 1 and show the same parts at different stages in the cycle which will now be described. It is convenient to regard the position shown in FIG. 1 as the start of the cycle.

As shown in FIG. 1 the inlet channel 29 supplies working fluid under pressure into the cylinder 23 and also, via the vent 33 into the balance cylinder 31. The pressure in the cylinder 23 accelerates the hammer 22 which moves towards the boring head 21. The working fluid displaced by this movement passes through the control vent 26 and the exhaust channels 28 to the rear of the ram until the vent 26 is covered by the control piston 24. The pressure in the cylinder 23 also acts on the control member 25 but it is counter-balanced by the pressure in the balance cylinder 31. Thus the pressure of the working fluid produces no tendency for the control member 25 to move backwards and the control member 25 remains in the forward position because of bias spring 18. The reaction from the acceleration of the hammer 22 is conveyed, via the control member 25 and the support block 27, to the surroundings of the body 20. When boring the friction of the soil is enough to resist this reaction so the ram does not move backwards.

FIG. 2 illustrates the position when the hammer has moved far enough for the control ports 26 to be in front of the control piston 24. At this stage the working fluid passes through the control ports 26 so that the pressure in the internal cavity 19 becomes equal to the pressure in the cylinder 23. Since the outer cross-section of the hammer 22 is larger than the inner cross-section of the cylinder 23 there is a net backward force which tends to stop and reverse the hammer. However, with the control member 25 in the position shown in FIG. 2, the hammer 22 does not stop until it strikes the boring head 21 (as shown in FIG. 3).

The impact on the boring head 21 produces a large transient force which has two effects:

i The boring head 21 will break up the ground ahead of the ram and compact it to the sides thereby creating new hole.

ii As the large transient force is greater than the frictional resistance the ram as a whole will advance.

After impact the hammer 22 will begin to retreat there are two mechanisms which drive this motion, ie:

a. Any elasticity in the chisel will cause rebound.

b. As mentioned above, the outer cross-section of the hammer 22 is larger than the cross-section of the cylinder 23 so there is positive drive from the working fluid until the control ports 26 are closed by the control piston 24.

Thus the hammer 22 is driven backwards until the control ports 26 are closed by the control piston 24. When this happens the momentum of the hammer 22 continues the backward motion until the position shown in FIG. 1 is achieved. When the control ports 26 clear the control piston 24 the pressure in the cavity 19 is discharged via the control ports 26 and the exhaust channels 28. Thus the hammer 22 is moving against the unbalanced pressure of the working fluid and therefore its backward motion is stopped before the hammer 22 impacts with the support block 27. At this time the cycleis complete and the next cycle starts at once so that the sequence described above repeats over and over again so long as working fluid at suitable pressure is supplied via the inlet channel 29.

Thus the friction of the surroundings prevents movement of the ram and its outer surface may be serrated to increase this friction. When the hammer hits the boring end 21 the soil in front of the chisel is compacted to create new hole and the impact advances the ram. If a stone is encountered the ram may remain stationary for several cycles until the stone is broken up when the advance will continue.

During use the ram tows flexible ducting 34 into the bore hole and working fluid is supplied via a pressure line 35 passing through the ducting 34. The working fluid is preferably compressed air at a pressure of 5–10 bars and air at this pressure is conveniently supplied by a small compressor.

It is sometimes necessary to withdraw the ram from its bore hole, eg if it encounters an unexpected obstacle which it too hard to break up. The ram according to the invention has a reverse mode in which it travels backwards through its own hole. This reverse mode will now be described with reference to FIGS. 4, 5 and 6.

In order to engage the reverse mode the control member 25 is moved to its rearward position as shown in FIG. 4. Tha balance piston 32 and the balance cylinder 31 are provided so that there is no pressure of working fluid to oppose this adjustment which is easily effected by tension, determined by the bias spring 18, on the pressure line 35.

As a modification (not shown in any drawing) a latch is provided to hold the control member 25 in the rearward position.

As described with respect to FIG. 1, working fluid enters the cylinder 23 and accelerates the hammer 22 towards the boring head 21. As described with respect to FIG. 2 working fluid enters the cavity 19 when the control ports 26 clear the control piston 24. However, as can be seen in FIG. 5, this occurs with the hammer further away from the boring head 21 so that the counter pressure in the cavity 19 stops the hammer 22 before it hits the boring head 21. The hammer 22 therefore moves backwards as described above until the control ports clear the control pistons. This occurs so far to the rear that the hammer 22 hits the support block 27 as shown in FIG. 6. This impact drives the ram backwards into its own hole. It also stops the hammer so that the cycle repeats.

As shown in FIGS. 1–6 the boring head 21 takes the form of a chisel rigidly attached at the front end. Since the chisel wears out more quickly than the ram, the chisel is not integral with the ram but attached by, for example, a screw thread. Other forms of chisel, eg as shown in FIGS. 7 and 8, may also be used.

As shown in FIG. 7 the boring head comprises a stepped chisel 10 attached to a rod 11 having an anvil 12 on its rear end. The rod 11 is slideably mounted in a bearing 15 provided on the front end of the body 20. A spring 13, spirally wound on the rod 11, holds the chisel 10 close to the end of the ram.

The arrangement shown in FIG. 8 is similar to that of FIG. 7. The differences are that the spring in FIG. 7 has a higher modulus than the spring of FIG. 8. Also the end face 14 is further from the anvil 12 in FIG. 7 than in FIG. 8.

The mode of operation of the two boring heads will now be described.

In both embodiments the hammer (not shown in FIGS. 7 and 8) hits the anvil 12 and, initially, the force of the impact is transferred to the ground. In FIG. 7 the long travel of the rod 11 and the high modulus of the spring 13 make it unlikely that the anvil will contact the end face 14. Very little impact is transferred to the body 20 since the force is conveyed by the spring 13.

In FIG. 8 the initial impact is taken entirely by the formation but the weak spring and short travel of the rod make it very likely that the anvil will contact the end face 14. Thus the propulsion is percussive. Since the ground takes the initial impulse the impulsive effect on the body 20 is less than in the case of a rigid chisel (as shown in FIGS. 1–6).

The ram described herein is convenient to reverse and start. To reverse, the control number 25 is moved between its two positions while the hammer 22 is in motion and the supply of working fluid is maintained. Thus the ram can switch from "forwards" to "reverse" (and vice versa) without any break in operation. This is an improvement over known boring rams which require interruption of the fluid supply to enable reversal, as such boring rams may not restart once stopped as the hammer may be in an equilibrium position.

It is possible for the hammer 22 to come to rest in an intermediate position where it is in equalibrium when working fluid is applied. In a ram according to this invention a movement of the control member 25 while the working fluid is under pressure disturbes the equilibrium and starts the operation.

We claim:

1. A self-propelled reversible boring ram comprising a tubular body which contains a reciprocable hammer and a pneumatically balanced reciprocable control member for supplying working fluid to the hammer in either a forward motion mode position or a reverse motion mode position, said control member having oppositely directed piston surfaces which are at all times subjected to substantially balanced pneumatic forces from said working fluid in both said reverse and forward mode positions.

2. A boring ram as claimed in claim 1 wherein the hammer has a main cylinder and wherein the control member comprises a control piston with one end having a first one of said surfaces situated in said main cylinder and wherein said control piston also includes an inlet channel for supplying working fluid into the main cylinder.

3. A boring ram as claimed in claim 2 wherein the second piston surface of the control member comprises the other end of said control piston which is situated within a balance cylinder attached to the tubular body of the ram wherein the balance cylinder is connected to the inlet channel in such a manner that a forward pressure on the second piston surface counteracts a backward pressure on the first piston surface in the main cylinder.

4. A boring ram as claimed in claim 1 wherein the control member is spring biased into said forward mode position for causing forward motion of the ram.

5. A boring ram as claimed in claim 1 which additionally comprises a boring head having a chisel portion connected to an anvil which assembly of chisel and anvil is slidably mounted in a bearing provided in the front end of the body, the anvil being positioned to receive blows from the hammer when the ram is operating in the forward mode.

6. A self-propelled reversible boring ram comprising:

a tubular body;

a hammer contained within the body, said hammer being reciprocable by working fluid supplied to the ram; and a pneumatically balanced control member movable between a forward position for advancing the ram and a reversing position, rearwards of the forward position, for reversing the ram;

wherein said control member includes oppositely directed surfaces which are both subjected to the pressure of the working fluid such that the net pneumatic fluid pressure on said member is substantially balanced at both said forward and reversing positions of the control member and during motion of the control member between said forward and reversing positions.

7. A boring ram according to claim 6, including a main cylinder within the hammer, and wherein the control member comprises:

a control piston situated in said main cylinder and an inlet channel for supplying said working fluid into said cylinder.

8. A boring ram according to claim 7, including a balance cylinder within the tubular body, and wherein the control member includes:

a balance piston situated in the balance cylinder, and a vent between the inlet channel and the balance cylinder, whereby the pressure of working fluid acting in the advancing direction on the balance piston counteracts the pressure of working fluid in the main cylinder acting in the reversing direction on the control piston.

9. A boring ram as claimed in claim 6 wherein the control member is spring biased into a position for forward motion of the ram.

10. A boring ram as claimed in claim 6 which additionally comprises a boring head having a chisel portion connected to an anvil which assembly of chisel and anvil is slidably mounted in a bearing provided in the front end of the body, the anvil being positioned to receive blows from the hammer when the ram is operating in the forward mode.

* * * * *